US005701814A

United States Patent [19]

Herpst et al.

[11] Patent Number: 5,701,814

[45] Date of Patent: Dec. 30, 1997

[54] HYDRAULIC PRESS ASSEMBLY

[75] Inventors: Robert Herpst, 11 Trotters La., Mahwah, N.J. 07430; Ruben A. Diaz, Edgewater, N.J.

[73] Assignee: Robert Herpst, Mahwah, N.J.

[21] Appl. No.: 692,000

[22] Filed: Aug. 2, 1996

[51] Int. Cl.[6] ..... B30B 1/32

[52] U.S. Cl. ..... 100/269.15; 29/592; 29/428; 100/35; 100/214; 100/264; 100/269.17; 425/173; 425/451.2

[58] Field of Search ..... 100/35, 214, 219, 100/257, 264, 269.01, 269.15, 269.17, 271, 915; 29/428, 592; 425/173, 451.2

[56] References Cited

U.S. PATENT DOCUMENTS

| | | | |
|---|---|---|---|
| 1,012,572 | 12/1911 | Simpson | 100/269.01 |
| 1,985,598 | 12/1934 | Carver | 100/269.15 |
| 2,234,098 | 3/1941 | Wells | 100/269.15 |
| 2,316,734 | 4/1943 | Wells | 100/269.17 |
| 2,501,527 | 3/1950 | Levinsohn et al. | 100/269.15 |
| 2,817,290 | 12/1957 | Parker et al. | 100/269.01 |
| 3,315,310 | 4/1967 | Weissman | 425/173 |
| 4,131,403 | 12/1978 | Keith, Jr. | 100/271 |

FOREIGN PATENT DOCUMENTS

| | | | |
|---|---|---|---|
| 92/20517 | 11/1992 | WIPO | 100/269.01 |

*Primary Examiner*—Stephen F. Gerrity
*Attorney, Agent, or Firm*—Watov & Kipnes, P.C.

[57] ABSTRACT

A hydraulic press assembly and method of making the same in which a substantial portion of the housing encompassing the press is formed of a unibody construction from structural tubing to provide a durable lightweight hydraulic press.

9 Claims, 3 Drawing Sheets

HYDRAULIC PRESS ASSEMBLY

TECHNICAL FIELD

The present invention is directed to a hydraulic press assembly which is especially adapted for use in compressing powders and the like to form pellets or disks or for forming films from polymers in which a substantial portion of the housing encompassing the press is formed from tubing being in the form of a rectangular solid having a hollow core to provide a lightweight, unibody construction which enables the press to be manufactured and shipped at significantly lower cost.

BACKGROUND OF THE INVENTION

Hydraulic presses, especially adapted for the preparation of pellets or disks from powders or the formation of films from polymers typically include a hydraulic pump which exerts upward pressure on a vessel. A substance contained in the vessel is therefore pressed against a fixed platform to thereby compress the substance which may be in the form of a powder or the like. Typical hydraulic presses of this type have all of the typical components exposed (i.e. they are not enclosed within a housing) or are built from heavy steel plates held together by bolts.

In many applications, it is desirable to have the area around the vessel contained within a protective shield so as to prevent accidental discharge of the substances or vessels containing the substances. Typical prior art devices with exposed components, such as two-column and four-column presses, have been provided with cumbersome protective shields that fit over the vessel and surround all sides of the press. Such presses are both heavy and expensive to manufacture. Presses constructed of steel plates held together by bolts are less cumbersome, but remain very heavy.

Typical prior art hydraulic bench scale presses are made out of solid steel and therefore weigh more than 100 lbs. for a 12 ton press. Such weights make it difficult and expensive to ship the hydraulic presses, especially over long distances, and make it cumbersome to move in the laboratory.

It would therefore be a significant advance in the art of hydraulic presses to provide a hydraulic press which has significantly less weight than typical prior art devices and includes a built-in safety shield which can be easily employed by the user while adding very little weight to the press itself.

SUMMARY OF THE INVENTION

The present invention is directed to a lightweight hydraulic press assembly which contains a built-in safety shield which may be readily operated by the user. The present hydraulic press is as strong and durable as typical prior art presses but weighs up to or more than 50% less than devices currently on the market.

In particular, the hydraulic press assembly of the present invention comprises:

a) hydraulic pump means for generating an upwardly directed pressure on a platform;

b) a platform for receiving a substance to be compressed; and c) a housing containing at least a portion of said hydraulic pump means and said platform, which together form a load bearing assembly, said housing comprising at least four sides including a top side, a bottom side and a pair of opposed sides with at least three of said sides formed from a rectangular solid having a hollow core.

In a preferred form of the invention, the hydraulic press assembly includes a pressure exerting means for exerting a downwardly directed pressure on the platform. In another embodiment of the invention, the housing is provided with an opening adapted to receive a protective shield therein for allowing the user to safely view the area where the substance is exposed to pressure from the hydraulic pump means.

The employment of a tubular construction as defined herein significantly reduces the cost of manufacture and shipping by lowering the weight of the press by as much as 50% or more.

BRIEF DESCRIPTION OF THE DRAWINGS

The following drawings in which like reference characters indicate like parts are illustrative of embodiments of the invention and are not intended to limit the invention as encompassed by the claims forming part of the application.

DETAILED DESCRIPTION OF THE INVENTION

The present invention is directed to a hydraulic press assembly in which the housing has a top side, a bottom side and at least two opposed sides with three of the sides formed from a rectangular solid having a hollow core. This type of material is often referred to as structural tubing or extruded tubing. For example in the case of steel as the material of construction, it is known as "cold formed electric resistance welded carbon steel tubing". In accordance with the present invention, the heavy steel bars and bolts used for the housing in prior an hydraulic presses is eliminated. The housing is thereby at least in pan in the form of a unibody (non-bolted) construction which enables the weight to be significantly reduced. There is also provided a protective shield insertable into an opening of the housing which allows the user to view the item to be pressed without the risk of injury.

Bench scale hydraulic presses, typically with pressure limits of up to 50 tons, contain a hydraulic pump, a platform upon which sits the substance to be compressed and a plate which lies between the hydraulic pump and the platform and acts to compress the substance when pressure is applied by the hydraulic pump. A typical example of a prior art bench scale hydraulic press is shown in FIG. 1.

Figure 1:
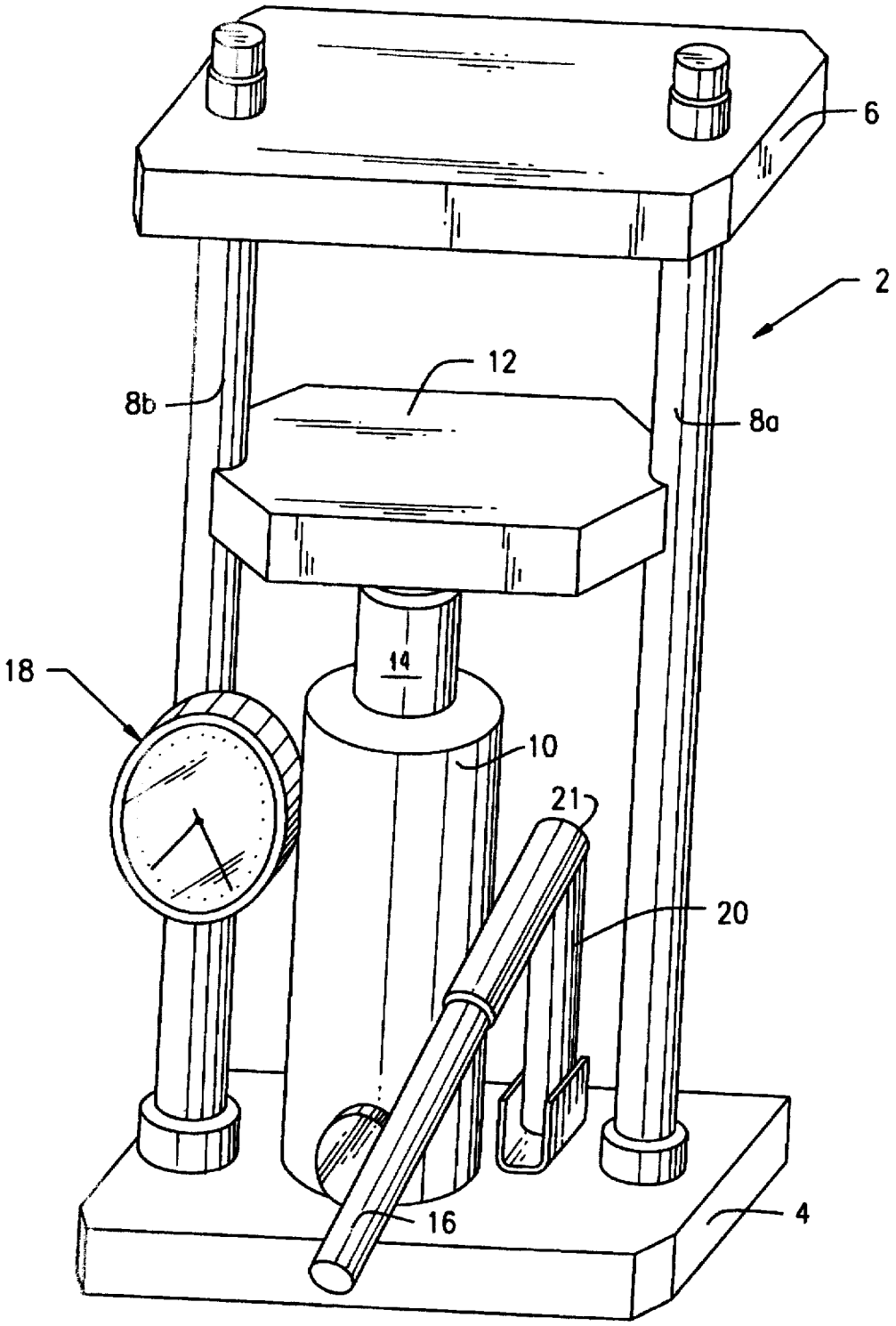
(PRIOR ART) FIG. 1
FIG. 1 is a perspective view of a typical prior an bench scale hydraulic press.

Referring to FIG. 1, there is shown a typical two-column prior art hydraulic press 2 comprised of a lower plate 4, an upper plate 6 and opposed columns 8*a* and 8*b* connecting and maintaining the upper and lower plates 4 and 6 in spaced-apart relationship. The columns are typically made out of solid metal, preferably steel and are therefore very heavy and add significantly to the overall weight of the prior art hydraulic press. It will be understood that some prior art hydraulic presses are comprised of four columns.

Positioned between the upper and lower plates 4, 6 is a hydraulic pump 10 which when activated can exert upward pressure, as for example up to 50 tons. Above the hydraulic pump 10 is a platform 12 which is in contact with the spaced apart columns 8a and 8b and movable therebetween up to pressurized contact with the upper plate 6.

An optional vessel such as a die for housing a powder or like material such as a polymer for forming a film (not shown) can be placed upon the upper surface of the platform 12 and is thereby movable with the platform 12.

Movement of the platform 12 is initiated by activating the hydraulic pump 10 so that the upper portion thereof or ram 14 exerts upward pressure on the platform 12. The pressure from the hydraulic pump 10 is instigated by inserting a lever action pump handle 16 into a suitable opening of the hydraulic pump 10 as is customary in the art. The lever action pump handle drives a pump plunger (not shown) in a pump cylinder 20 and is connected thereto by a linkage assembly designated by numeral 21. This mode of action activates the hydraulic press to apply pressure on the substance to be compressed.

More specifically, the hydraulic pump 10 is activated so that the vessel positioned on the platform 12 is movable upwardly into contact with the upper plate 6. Pressure is exerted on the vessel and therefore on the substance to be compressed by the upward pressure exerted by the hydraulic pump 10. The amount of pressure applied to the substance can be observed by reference to a customary pressure gauge 18.

Recently, hydraulic presses of the type shown in FIG. 1 have been required to have a protective shield lying between the user and the vessel located on the platform 12. The protective shield is a desirable safety element because if the vessel should become dislodged while under pressure, it could be ejected from the press at significant speeds and thereby pose a threat to the user. Accordingly, boxlike protective shields have been provided about the hydraulic press completely covering the upper plate 6. The prior art protective shields extend downwardly to cover at least a portion of the hydraulic pump 10 including completely covering the travel path of the platform 12.

Another type of prior art press comprises a housing made of spaced apart solid metal plates with bolts connecting the same.

Prior art devices of the type shown in FIG. 1 are disadvantageous because they are very heavy owing to the extensive weight of the columns 8a and 8b and the metal plates 4, 6 and 12 which are necessary to provide proper support so as to resist the pressures exerted by the hydraulic pump 10. In addition, protective shields which are adapted for use with hydraulic presses of the two-column and four-column type are cumbersome and expensive to manufacture and add significantly to the weight of the overall apparatus. Hydraulic presses with bolted steel plate assemblies are less cumbersome but remain heavy and expensive to manufacture.

In accordance with the present invention, there is provided a hydraulic press assembly which can be made up to or exceeding 50% lighter in weight than conventional hydraulic presses and is less expensive to manufacture.

Figure 2:
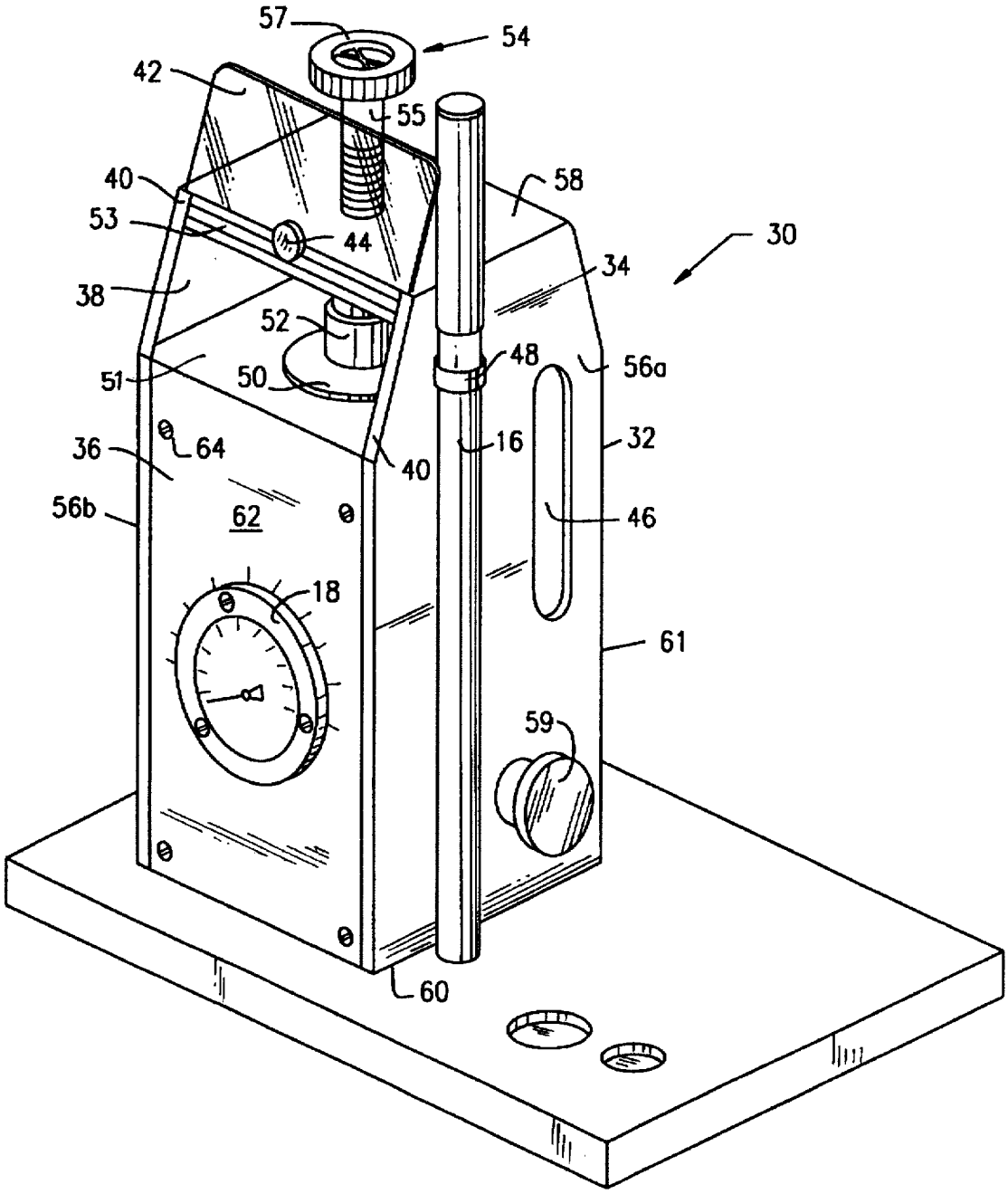
FIG. 2 is a perspective view of an embodiment of the present invention showing a protective shield in a raised position exposing a vessel containing the substance to be pressed.
Figure 3:
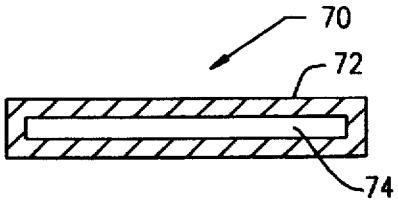
FIG. 3 is a cross-sectional view of a portion of the housing showing a hollow core tubing.
Figure 4:
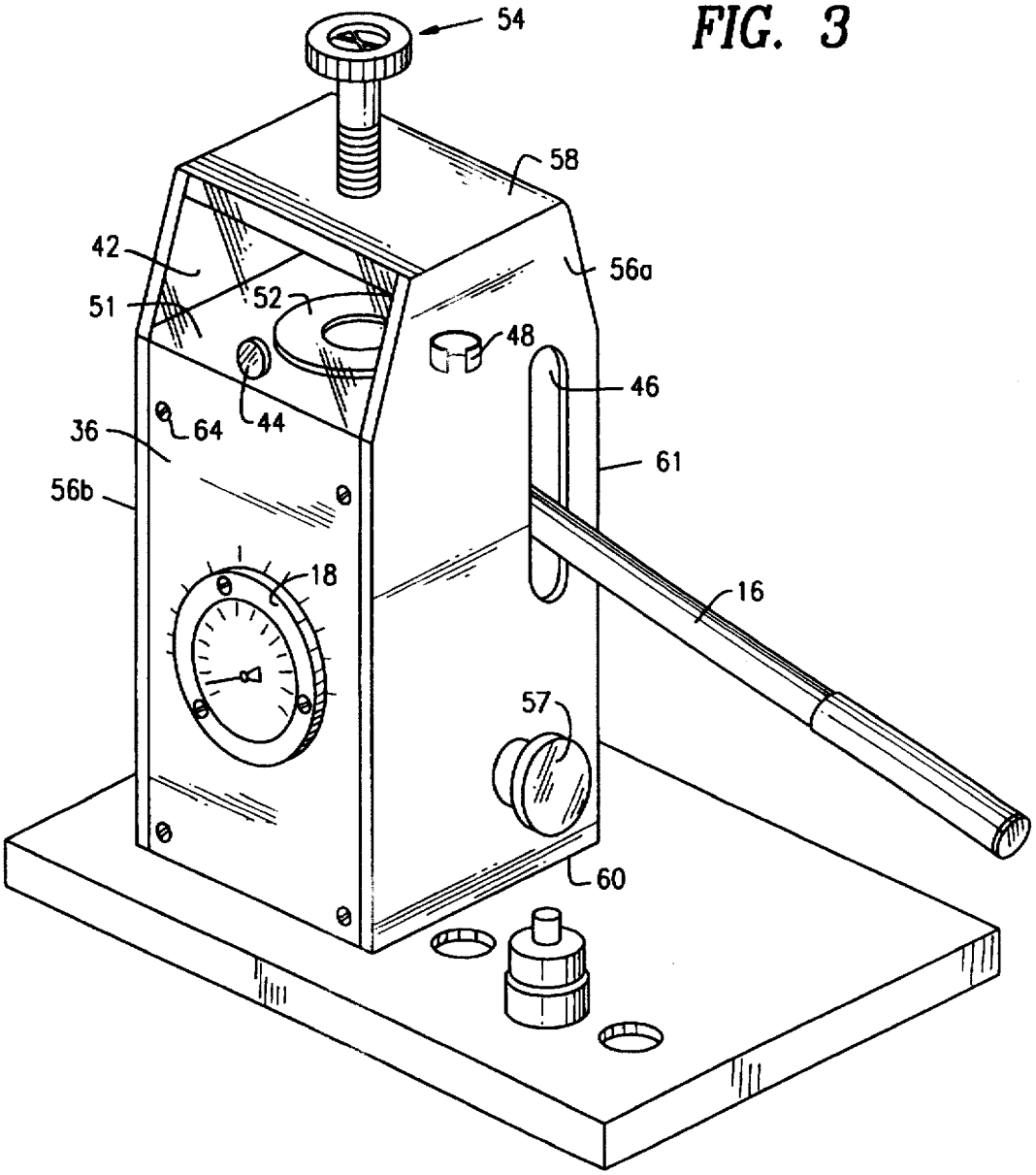
FIG. 4 is a perspective view of an embodiment of the invention similar to FIG. 2 with the protective shield in place.

Referring to FIGS. 2–4, there is shown an embodiment of a hydraulic press assembly in accordance with the present invention. Specifically, the embodiment shown in FIGS. 2–4 is directed to a hydraulic press 30 substantially encased within a housing 32 having an integral first region 34 and a second region 36 as explained in detail hereinafter.

The housing 32 contains an opening 38 bounded in part by spaced apart runners or channels 40 which enables a protective shield 42 to be placed over the opening 38 through movement by handle 44.

Contained within the housing 32 is a standard hydraulic pump of the type shown in prior art FIG. 1. The hydraulic pump is operated by a lever action pump handle 16 which engages the hydraulic pump through an opening 46 of the housing 32. As shown specifically in FIG. 2, the handle 16 may be held in place when not in use by a clasp 48.

The housing also contains a platform 50 upon which can rest a vessel 52 such as a die which contains the substance to be compressed. The hydraulic pump and the platform together constitute the load bearing assembly. A plate 53 may optionally be added above the vessel 52 to add strength to the assembly and to provide a flat surface for the vessel 52 to be compressed against. A rotatable wheel assembly 54 comprised of a threaded rod 55 and a wheel drive 57 may be employed to maintain the vessel 52 in a desirable position for compressing the substance contained within it by reducing the space between the platform 50 and the plate 53 if the height of the vessel 52 is insufficient to allow compression of the substance contained therein by the stroke or length of movement of the hydraulic pump.

In operation of the hydraulic press assembly of the present invention, the vessel 52 is filled with a substance (e.g. a powder) to be compressed. The wheel assembly 54 is rotated so that the space is reduced sufficiently to allow the substance within the vessel 52 to be compressed by the stroke of the hydraulic pump. The handle 16 is removed from the clasp 48 and inserted into the opening 46 where it engages the hydraulic pump (not shown). The handle 16 is then moved up and down so as to cause the hydraulic pump to exert an upward pressure against the platform 50 thereby causing the powder to be compressed when the vessel 52 engages either the plate 53 or the end of the threaded rod 55 attached to the wheel 54 under pressure. The pressure exerted on the vessel 52 by the pump 10 can be released by activating a pressure relief valve through a knob 59 or similar device.

In accordance with the present invention, the housing 32 is comprised of at least four sides in which at least three of the sides are formed of a unibody construction wherein the sides are integral with each other and are formed from structural tubing. This contrasts with prior art devices formed from separate plates held together by mechanical means such as bolts.

An embodiment of the structural tubing employed for construction of the hydraulic press assembly of the present invention is shown in FIG. 3. The structural tubing 70 is comprised of a solid outer region 72 circumscribing a hollow core 74.

Referring to FIGS. 2–4, the housing 32 includes a first region 34 which includes opposed sides of the device 56a and 56b, the top of the device 58 and the bottom of the device 60. At least three of these components of the housing comprising the first region 34 are made of a rectangular solid having a hollow core (i.e. structural tubing), as described above in connection with FIG. 3, so that the region 34 is formed in an integral, unibody construction. As a consequence of this construction, the thickness of the housing and its overall weight can be significantly reduced over prior art devices which rely on heavy steel columns or heavy steel plates connected by heavy bolts for support of the hydraulic pump.

In a preferred form of the invention, the structural tubing has a thickness of between ¼" and ½". The preferred materials of construction are steel and aluminum although other metals or metal alloys can be used as well as composite materials such as fiberglass and the like.

The second region 36 of the housing 32 comprises at least one non-structural sheets or plates shown by numerals 51, 61 and 62 which are secured to the first portion 34 through screws 64 or the like. The sheets or plates 51, 61 and 62 can be removed to expose the hydraulic press for repair, cleaning or the like.

Contiguous with and lying above the plate 62 is the opening 38 which houses the protective shield 42 as previously described.

What is claimed is:

1. A hydraulic press assembly comprising:

a) hydraulic pump means for generating an upwardly directed pressure on a platform;

b) a platform for receiving a substance to be compressed; and c) a housing containing at least a portion of said hydraulic pump means and said platform, which together form a load beating assembly, said housing comprising at least four sides including a top side, a bottom side and a pair of opposed sides with at least three of the sides formed from a rectangular solid having a hollow core.

2. The hydraulic press assembly of claim 1 wherein the housing is made of structural tubing.

3. The hydraulic press assembly of claim 1 wherein the housing is made of metal or a composite material.

4. The hydraulic press assembly of claim 3 wherein the housing is made of steel or aluminum.

5. The hydraulic press assembly of claim 1 wherein the housing comprises a front side, said front side having a lower portion comprised of a removable panel and an upper portion, said upper portion containing an opening.

6. The hydraulic press assembly of claim 5 wherein the upper portion of the housing further comprises opposed runners for receiving a protective shield, a protective shield; and means for moving the protective shield along said runners from a first position allowing access to the substance to be compressed to a second position preventing access to the substance to be compressed.

7. The hydraulic press assembly of claim 1 further comprising pressure exerting means for exerting a downwardly directed pressure on the substance to be compressed.

8. A method of forming a hydraulic press assembly comprising:

a) hydraulic pump means for generating an upwardly directed pressure on a platform;

b) a platform for receiving a substance to be compressed; and c) a housing containing at least a portion of said hydraulic pump means and said platform, which together form a load bearing assembly, said housing comprising at least four sides including a top side, a bottom side and a pair of opposed sides, said method comprising forming a least three of the sides of the housing from a rectangular solid having a hollow core.

9. The method of claim 8 comprising forming at least three sides of the housing from structural tubing.

* * * * *

UNITED STATES PATENT AND TRADEMARK OFFICE

CERTIFICATE OF CORRECTION

PATENT NO. : 5,701,814

DATED : December 30, 1997

INVENTOR(S) : Robert Herpst and Ruben A. Diaz

It is certified that error appears in the above-identified patent and that said Letters Patent is hereby corrected as shown below:

Column 1, line 40 cancel "it" insert --them--
Column 2, line 18 cancel "an" and insert --art--
Column 2, line 44 cancel "pan" and insert --part--
Figure 4 cancel "52" and insert --50--
Figure 4 cancel "57" and insert --59--
Column 3, line 67 after "by" insert --a--
Column 5, line 2 cancel "...sheets or plates" and insert --sheet or plate--
Column 5, line 3 cancel "are" and insert --is--
Column 5, line 18 cancel "beating" and insert --bearing--

Signed and Sealed this

Fifteenth Day of May, 2001

*Attest:*

Nicholas P. Godici

NICHOLAS P. GODICI

*Attesting Officer*

*Acting Director of the United States Patent and Trademark Office*